United States Patent [19]

Spranger

[11] 4,180,710

[45] Dec. 25, 1979

[54] ADJUSTABLY POSITIONED PHASING PLUG

[75] Inventor: Paul B. Spranger, Fullerton, Calif.

[73] Assignee: Altec Corporation, Anaheim, Calif.

[21] Appl. No.: 936,484

[22] Filed: Aug. 24, 1978

[51] Int. Cl.[2] ..... H04R 9/06; H04R 31/00

[52] U.S. Cl. ..... 179/115.5 H; 29/594

[58] Field of Search ..... 179/115.5 H, 115.5 R; 29/594

[56] References Cited

U.S. PATENT DOCUMENTS

| | | | |
|---|---|---|---|
| 2,037,187 | 4/1936 | Wente | 179/115.5 H |
| 3,412,219 | 11/1968 | Karali | 179/114 |
| 3,619,434 | 11/1971 | Blastic et al. | 264/40 |

FOREIGN PATENT DOCUMENTS

| | | | |
|---|---|---|---|
| 545712 | 6/1942 | United Kingdom | 179/116 |

*Primary Examiner*—George G. Stellar

*Attorney, Agent, or Firm*—Edward A. Sokolski

[57] ABSTRACT

Apparatus and method for precisely adjusting the spacing between the phasing plug of a horn type loudspeaker driver and the diaphragm of such loudspeaker. The base of the pole piece is threaded and threadably engages a mating apertured portion of a back plate. A micrometer is employed to adjust the height of the phasing plug above the surface of the top back plate by rotating the phasing plug on its threads. In this manner, spacing between the phasing plug and the diaphragm can be precisely set for each assembly.

5 Claims, 3 Drawing Figures

ADJUSTABLY POSITIONED PHASING PLUG

This invention relates to horn type loudspeakers and more particularly to a method and apparatus for precisely adjusting the spacing between the phasing plug and the diaphragm of the driver unit for such a loudspeaker.

A phasing plug is generally used to transform the acoustical energy between the diaphragm and the horn unit of a horn type loudspeaker. It has been found that there is an optimum spacing between the phasing plug and the diaphragm for best frequency response and minimum distortion. The tolerances on this spacing are rather close and variations in this optimum spacing of the order of 0.010 inches will cause significant deterioration in speaker performance, particularly in the high frequency response of the speaker. Thus, in the manufacture of drivers for horn type loudspeakers, great pains are taken to maintain the tolerances of the components within very close limits to assure this optimum spacing in the production of the driver units. This need for close tolerances, of course, increases the cost of the fabrication of the driver components, particularly the pole piece units. In recent years, ceramic magnets have come into widespread use in speaker manufacture, these magnets being molded from iron oxide and barium or strontium carbonate composites. Such ceramic magnets have the advantage of economy of fabrication and further lend themselves to flatter type construction than metal pole pieces. However, such molded parts tend to vary more than would be desired in their dimensional tolerances, and if to be used in a precision driver unit of the type contemplated, must be closely checked and ground to proper size, which of course increases the cost and the time required for fabrication.

The method and apparatus of the present invention obviates the need for maintaining the components of the driver unit to very close tolerances by providing a simple and highly precise means for adjusting the diaphragm-phasing plug spacing on a unit by unit basis. Thus, the tolerances on the components can be significantly relaxed, permitting the use of ceramic magnets without any special grinding of these parts to size, thereby greatly economizing the fabrication. Further, it is possible to very precisely adjust the spacing between the diaphragm and the phasing plug to assure optimum performance for each unit without concern as to dimensional variations which might crop up in assembly.

It is therefore an object of this invention to economize the fabrication of precision horn type loudspeakers.

It is a further object of this invention to improve the high frequency response of horn type loudspeakers.

It is still another object of this invention to provide a simple method and apparatus for individually adjusting the spacing between the diaphragm and phasing plug of a horn type loudspeaker so as to optimize the high frequency response thereof.

Other objects of this invention will become apparent as the description proceeds in connection with the accompanying drawings, of which:

Briefly described, my invention is as follows:

The driver of a horn type loudspeaker has a centrally positioned magnetic pole piece in which a phasing plug is mounted, this pole piece being cylindrical in configuration and having a threaded base portion. This threaded base portion engages and is adjustable in position axially on a mating threaded portion of a back plate of magnetic material which is attached to a radiating horn unit. Mounted on the back plate in external concentricity with the central pole piece are a magnet unit and a top plate of magnetic material in succession, the top plate supporting the speaker diaphragm and voice coil assembly. A magnetic gap is formed between the pole piece and the centrally apertured unitary assembly formed by the back and top plates and the magnet unit, the voice coil being supported in this gap. An optimum spacing between the diaphragm and the phasing plug for the particular speaker in question is pre-determined. This spacing is then precisely achieved by threadably adjusting the central pole piece in the back plate until a desired relative positioning between the top plate and the uppermost surface portion of the phasing plug is achieved with the aid of a micrometer.

Figure 1:
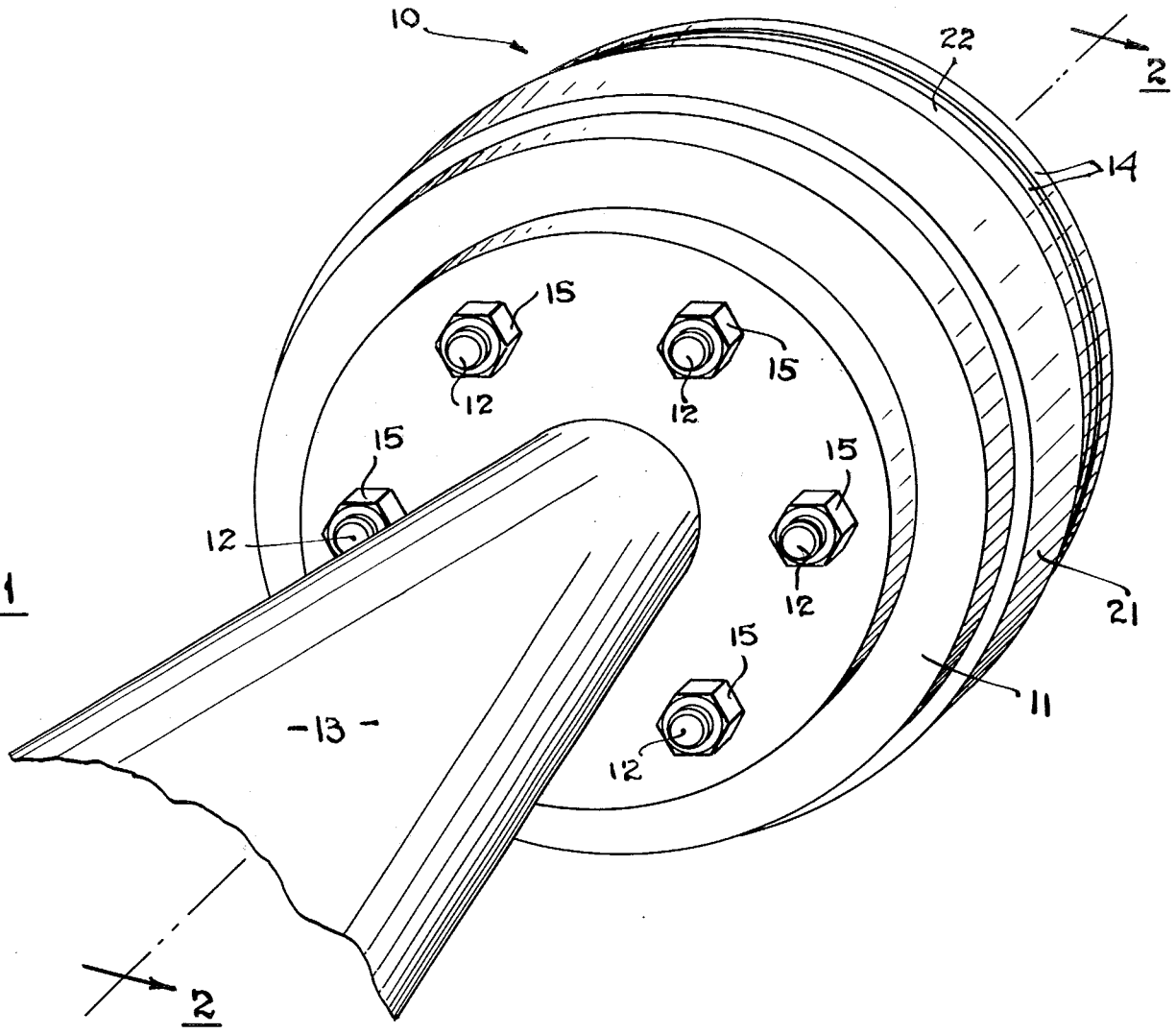
FIG. 1 is a perspective view of a preferred embodiment of the invention.
Figure 2:
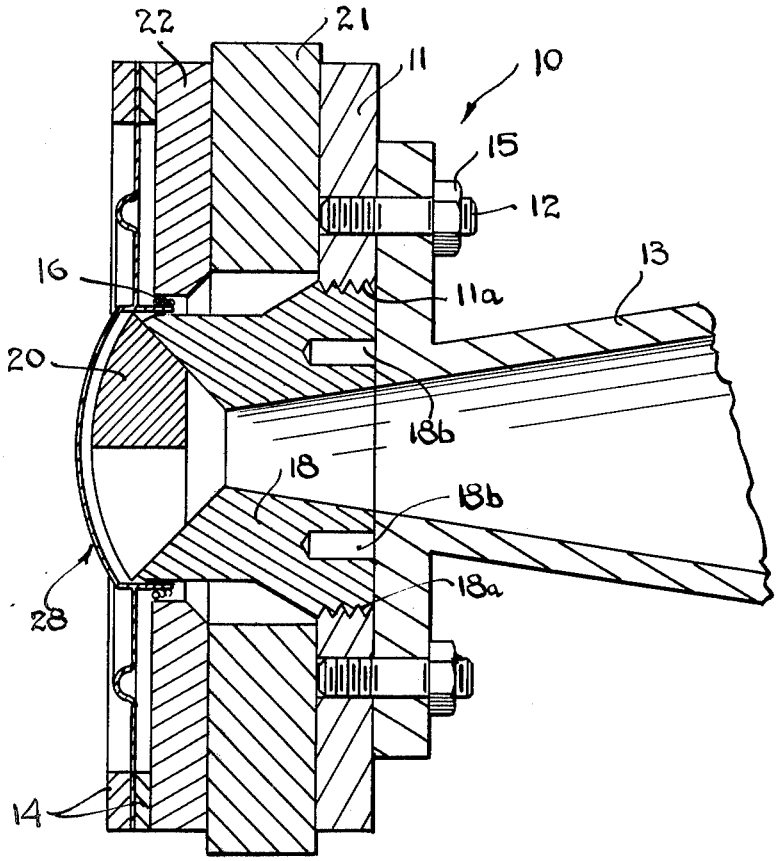
FIG. 2 is a cross-sectional view taken along the plane indicated by 2—2 in FIG. 1.

Referring now to FIGS. 1 and 2, a preferred embodiment of the invention is illustrated. The basic structure of this embodiment is similar to that described in U.S. Pat. No. 4,050,541 assigned to Altec Corporation, the assignee of the present application. Driver unit 10 includes a back plate 11 which has a plurality of threaded studs extending therefrom to which the speaker horn 13 is attached by means of nuts 15. Back plate 11 is in the form of a disc and has a threaded aperture **11*a* formed in the central portion thereof. Central pole piece member 18 has a threaded base portion 18*a* which engages the threaded portion 11*a* of the back plate. Mounted against back plate 11 in external concentricity with pole piece 18 is disc shaped permanent magnet 21 which may be a ceramic magnet fabricated of a barium-iron oxide composite. Mounted against magnet 21 and in external concentricity with pole piece unit 18 is top plate 22. Top plate 22, back plate 11 and pole piece unit 18 are all fabricated of a suitable magnetic material such as steel. Top plate 22, back plate 11 and magnet 21 are joined together, as for example by cementing, to form an integral unit. A pair of apertures 18*b* are formed in the bottom of pole piece 18, these apertures being adapted to accommodate a spanner wrench which may be used in rotatably adjusting the pole piece on its threaded attachment to the back plate. Phasing plug 20, which may be of the type described in the aforementioned patent, is cemented to the pole piece. Diaphragm assembly 28 on which the speaker voice coil 16 is wound, is supported between ring clamps 14, which are fixedly attached to top plate 22**.

Figure 3:
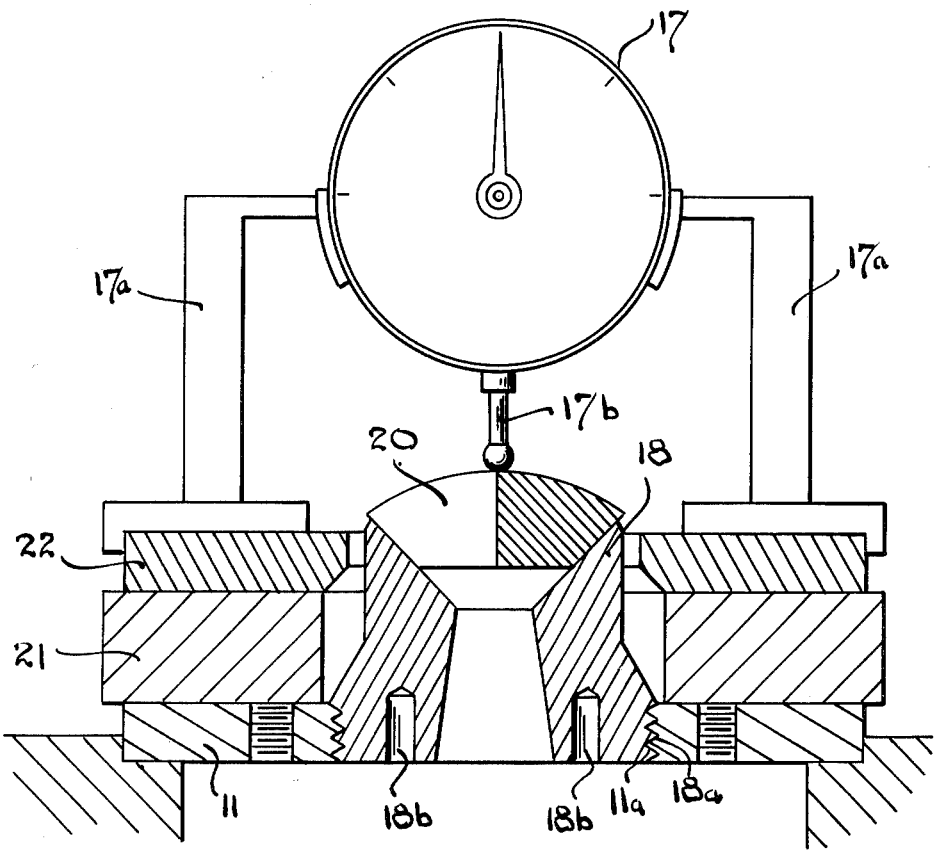
FIG. 3 is a diagrammatic view illustrating the use of the method of the invention in adjusting the spacing between the diaphragm and the phasing plug.

As should be apparent, pole piece 18 can be adjusted in position relative to diaphragm 28 by virtue of its threadable attachment to back plate 11. This adjustment is achieved by means of a precision direct reading dial micrometer, as shown in FIG. 3. This adjustment is made prior to the mounting of the diaphragm assembly 28. Micrometer 17 is positioned so that its caliper leg portions **17*a* rest on the top surface of top plate 22 while its caliper arm 17*b* is abutted against the uppermost portion of the top surface of phasing plug 20. Back plate 11 is mounted on stand to permit access with a spanner wrench to apertures 18b. In this manner, a reading is obtained on the dial indicator of the micrometer, which precisely indicates the relative axial positioning between the phasing plug and top plate 22, and diaphragm 28 which is fixedly attached to the top plate when it is installed. Thus the axial positioning of phasing plug 20 can be adjusted by means of a spanner wrench which is inserted in apertures 18b** and rotated until the predetermined desired reading is obtained on indicator dial to determine the precise distance between the phasing plug and the diaphragm in the finally assembled unit.

While the invention is described and illustrated in detail, it is to be clearly understood that this is intended by way of illustration and example only and is not to be taken by way of limitation, the spirit and scope of this invention being limited only by the terms of the following claims.

I claim:

1. In a horn type loudspeaker having a driver unit which includes a centrally positioned magnetic pole piece, a phasing plug fixedly mounted on said pole piece, a magnet unit and top and back plates forming a centrally apertured unitary assembly mounted in external concentricity with said pole piece to form a magnetic gap therebetween, and a diaphragm-voice coil assembly fixedly attached to said unitary assembly having a voice coil mounted in said magnetic gap, the improvement comprising:

means for axially adjusting the position of the phasing plug relative to the diaphragm including a threaded portion of said pole piece and an apertured portion in said unitary assembly in external concentricity with said threaded portion of the pole piece which threadably engages said cylindrical threaded pole piece portion, whereby the phasing plug is moved axially relative to the mounted position of the diaphragm with relative rotation between the pole piece and the unitary assembly.

2. The loudspeaker of claim 1 wherein the cylindrical threaded portion is formed in the back plate.

3. The loudspeaker of claim 2 wherein the threaded portion of said pole piece is cylindrical and forms the base of said pole piece.

4. The loudspeaker of claim 3 wherein the pole piece base has apertures formed therein for receiving a spanner wrench for use in rotating the pole piece relative to said unitary assembly.

5. A method for setting the distance between the phasing plug and diaphragm of a horn type loudspeaker, said loudspeaker including a magnet unit and top and bottom plates forming a centrally apertured unitary assembly, a portion of which is threaded, a pole piece in internal concentricity with the unitary assembly and having a threaded portion which engages the threaded portion of the unitary assembly, and a diaphragm-voice coil assembly fixedly mounted on the unitary assembly with the voice coil thereof mounted in the magnetic gap formed between the pole piece and the unitary assembly, the phasing plug being fixedly mounted on the pole piece opposite the diaphragm, comprising, prior to the mounting of the diaphragm-voice coil assembly on said unitary assembly, the steps of:

placing a micrometer with one of its caliper elements abutting against the uppermost portion of the phasing plug and the other of said caliper elements abutting against a predetermined portion of said unitary assembly, and rotating the pole piece relative to the unitary assembly to axially position the phasing plug relative to the unitary assembly until a predetermined reading is obtained on the micrometer.

* * * * *